US010804059B2

(12) United States Patent
Westebbe et al.

(10) Patent No.: US 10,804,059 B2
(45) Date of Patent: Oct. 13, 2020

(54) MAGNET ARMATURE, CONTACTOR HAVING A MAGNETIC ARMATURE, AND METHOD FOR SWITCHING A CONTACTOR

(71) Applicant: Epcos AG, Munich (DE)

(72) Inventors: Thomas Westebbe, Berlin (DE); Frank Werner, Berlin (DE); Peter Bobert, Falkensee (DE)

(73) Assignee: EPCOS AG, Munich (DE)

( * ) Notice: Subject to any disclaimer, the term of this patent is extended or adjusted under 35 U.S.C. 154(b) by 179 days.

(21) Appl. No.: 15/744,328

(22) PCT Filed: Jun. 22, 2016

(86) PCT No.: PCT/EP2016/064467
§ 371 (c)(1),
(2) Date: Jan. 12, 2018

(87) PCT Pub. No.: WO2017/012816
PCT Pub. Date: Jan. 26, 2017

(65) Prior Publication Data

US 2018/0204698 A1 Jul. 19, 2018

(30) Foreign Application Priority Data

Dec. 3, 2015 (DE) ..... 10 2015 121 033

(51) Int. Cl.
*H01H 50/56* (2006.01)
*H01H 50/20* (2006.01)
(Continued)

(52) U.S. Cl.
CPC ..... *H01H 50/20* (2013.01); *H01H 50/36* (2013.01); *H01H 50/44* (2013.01); *H01H 50/56* (2013.01);
(Continued)

(58) Field of Classification Search
CPC ..... H01H 50/56–50/58
See application file for complete search history.

(56) References Cited

U.S. PATENT DOCUMENTS 3,444,490 A 5/1969 Krummel
4,755,781 A 7/1988 Bogner
(Continued)

FOREIGN PATENT DOCUMENTS

DE 19814504 A1 6/1999
EP 0630034 A1 * 12/1994 ..... H01H 51/084
(Continued)

OTHER PUBLICATIONS

European Patent Office, International Search Report in corresponding International Application No. PCT/EP2016/064467, dated Aug. 23, 2016 (3 pages).

*Primary Examiner* — Ramon M Barrera
(74) *Attorney, Agent, or Firm* — Nixon Peabody LLP

(57) ABSTRACT

A microphone having a housing that includes a bottom part and an upper part, and a transducer element arranged in the housing and which is electrically and mechanically connected to the bottom part. For stress-free mounting of the transducer element, a flexible connecting element is proposed, which is pliable and/or compressible, is arranged between the transducer element and the upper part, and connects the transducer element to the upper part. The connecting element includes a plastic, in which gas bubbles are distributed, the gas bubbles having a volume fraction of between 50 and 98% in the connecting element.

16 Claims, 4 Drawing Sheets

(51) Int. Cl.

| | |
|---|---|
| ***H01H 50/64*** | (2006.01) |
| ***H01H 51/06*** | (2006.01) |
| ***H01H 50/36*** | (2006.01) |
| ***H01H 50/44*** | (2006.01) |

(52) U.S. Cl.
CPC ..... *H01H 50/645* (2013.01); *H01H 51/065* (2013.01); *H01H 50/64* (2013.01)

(56) References Cited

U.S. PATENT DOCUMENTS

| | | | | |
|---|---|---|---|---|
| 6,265,957 | B1 * | 7/2001 | Baginski ..... | H01F 7/1607<br>335/251 |
| 6,360,707 | B1 | 3/2002 | Boegner | |

FOREIGN PATENT DOCUMENTS

| | | | |
|---|---|---|---|
| EP | 2385538 | A1 | 11/2011 |
| GB | 646670 | A | 11/1950 |
| GB | 1082527 | A | 9/1967 |
| GB | 2028590 | A | 3/1980 |
| JP | 2005-276592 | A | 10/2005 |
| JP | 2006-019148 | A | 1/2006 |

* cited by examiner

MAGNET ARMATURE, CONTACTOR HAVING A MAGNETIC ARMATURE, AND METHOD FOR SWITCHING A CONTACTOR

CROSS-REFERENCE TO RELATED APPLICATIONS

This application is a U.S. National Stage of International Application No. PCT/EP2016/064467, filed Jun. 22, 2016, which claims the benefit of Germany Patent Application No. 102015112052.6, filed Jul. 23, 2015, and of Germany Patent Application No. 102015121033.9, filed Dec. 3, 2015, all of which are incorporated herein by reference in their entireties.

The invention relates to magnet armatures, for example magnet armatures for electromagnetic contactors, contactors having a magnet armature, and methods for switching a contactor.

In electromagnetically operable contactors, a magnet armature generally constitutes a moving part which can electrically conductively connect two electrodes by displacing a contact stamp. Contactors are used in order to switch strong electric currents and/or high electrical voltages, possibly in a protective-gas atmosphere. The instantaneous processes of closing or opening the switch and arcs which occur in the process constitute a high loading, in particular for the material of the electrodes and of the contact stamp, in the case of a high electrical power to be switched. The risk of said electrical contacts sticking increases as the number of switching processes increases.

Contactors with a so-called booster circuit for reducing the closing time are known. In this case, an overvoltage is briefly applied, that is to say applied for a few milliseconds, to the solenoid in order to increase the attraction force.

Therefore, switching processes with reduced loading for the electrode material, in particular switching processes with a reduced risk of the contacts sticking, are desirable.

The magnet armature described here, in particular the magnet armature according to independent claim 1, allows switching processes of this kind. The other claims specify advantageous refinements of the armature.

The magnet armature comprises a first spring element with a first stiffness k1, a second spring element with a second stiffness k2, an inoperative position, an end position and a central position which is located between the inoperative position and the end position. The first spring element is provided to be elastically deformed during a switching process during the movement from the inoperative position to the central position, but not during the movement from the central position to the end position. The second element is provided to be elastically deformed during the movement from the central position to the end position, but not during the movement from the inoperative position to the central position.

In this case, the inoperative position, the central position and the end position constitute positions of the magnet armature relative to its surrounding area, for example within an electromagnetic switch. The central position does not necessarily have to be the same distance away from the inoperative position as from the end position. In this case, the inoperative position indicates that position in which the magnet armature is located when there is no magnetic force acting on it. In this case, the end position indicates the equilibrium position when the magnetic force which is provided for closing a switch acts on the magnet armature and the electrical contact to be closed is permanently closed.

The first stiffness k1 of the first spring element and the second stiffness k2 of the second spring element can be different. Since the magnet armature moves against the restoring force of the first spring element during the movement from the inoperative position to the central position and against the spring force of the second element during the movement from the central position to the end position, a reduction in the switching time can be achieved. In particular when the spring stiffness k1 of the first spring element is lower than the spring stiffness k2 of the second spring element, the magnet armature works against a smaller resistance force during the attraction, so that a greater acceleration and therefore a reduction in the switching time is achieved.

If the magnet armature is located in its end position, the restoring force of the second spring element substantially causes rapid opening when the magnetic force on the magnet armature (that is to say during opening of the switch) is cancelled.

Therefore, the invention indicates a magnet armature which experiences a resistance force, which is not simply linear, during closing and during opening. Instead, the invention specifies a magnet armature of which the resistance force which acts on it can increase in succession due to different spring stiffnesses.

It is possible that the first spring element and the second spring element are arranged in series. When spring elements are arranged in series, this produces a resulting spring stiffness of the combination of the two springs, the reciprocal value of which corresponds to the sum of the reciprocal values of the individual spring stiffnesses. Therefore, two spring elements which are arranged in series behave like a single spring element with the corresponding equivalent stiffness. Additional technical precautions, for example mechanical stops and/or application of a spring pretension to individual spring elements and/or provision of a displaceable bush, as described below, are necessary in order for the magnet armature to assume different spring stiffnesses during activation firstly during the one phase of movement from the inoperative position to the central position and during the second phase during the movement from the central position to the end position.

It is therefore possible that the magnet armature additionally comprises a bush which is arranged between the first spring element and the second spring element. In this case, the bush can touch one end of the first spring element, which end is directed toward the bush, and one end of the second spring element, which end is directed toward the bush.

It is possible that the magnet armature additionally comprises a cylindrical section. The first spring element, the bush and the second spring element coaxially surround the cylindrical section—or in each case its own cylindrical section with a potentially different radius. The end of the first spring element which faces the bush is provided to move relative to the cylindrical section during the movement from the inoperative position to the central position, but not during the movement from the central position to the end position. The bush and that end of the second spring element which faces the bush are provided to move relative to the cylindrical section during the movement from the central position to the end position, but not during the movement from the inoperative position to the central position.

It is possible that a movement from the inoperative position to the end position corresponds a displacement by a distance h=h1+h2, where h can be between 1.5 mm and 2.5 mm long.

In this case, the distance h from the inoperative position to the end position is the full stroke which is covered by the magnet armature during activation in order to interconnect two electrodes of a contactor with a contact stamp.

The stroke h can be, for example, 2 mm.

It is possible that a movement of the magnet armature from its inoperative position to its central position corresponds to a displacement by a distance h1 which lies in an interval of between 0.4 times and 0.6 times the total stroke h=h1+h2.

In other words: the central position can lie in an interval of between 40% and 60% of the full stroke h.

The stroke elements by a distance h1 from the inoperative position to the central position and h2 from the central position to the end position can be the same: h1=h2=h/2.

It is possible that the spring stiffness of one of the two spring elements is approximately 3.3-3.6 times the respectively other spring stiffness. In this case, the second spring element can have the higher spring stiffness: $3.3 \leq k2/k1 \leq 3.6$.

Specifically, it is possible that the spring stiffness of the first spring element is between 0.5 N/mm and 0.9 N/mm. The stiffness of the second spring element can be between 2.3 N/mm and 2.7 N/mm.

It is possible that the magnet armature further comprises, in addition to at least one cylindrical section, a contact stamp and/or a magnetizable material. The contact stamp is arranged at one end of the region of the armature with the one or the plurality of cylindrical sections. The optional magnetizable material can be arranged at the opposite end. The contact stamp comprises an electrically conductive material and, in the end position of the magnet armature, is provided to interconnect two electrical contacts. The magnetizable material can comprise iron, cobalt and/or nickel or consist of iron, cobalt or nickel. The magnet armature can magnetically interact with its surrounding area (for example an adjacent magnet coil in a yoke) by means of the magnetizable material, in particular in order to allow displacement between the three positions, that is to say switching by means of the contact stamp.

It is possible that the cylindrical section comprises a first subsection and a second subsection. The first subsection can have a first diameter and the second subsection can have a second diameter. The cylindrical section, and therefore the diameter, can have a step between the two subsections. The step between the two subsections can constitute a fourth stop, in particular for the bush.

It is possible that the bush touches the fourth stop during the movement from the inoperative position to the central position (MP), but not during the movement from the central position to the end position.

As a result, it is possible that the bush decouples the two springs at least in one position, for example the inoperative position, or during the movement from the central position to the inoperative position, this improving the switching behavior of a correspondingly equipped contactor.

A contactor can comprise a magnet armature as described above having a bush between the two spring elements, a yoke with an integrated coil, and a guide with a first mechanical stop. The magnet armature and the yoke form an electromagnetic actuator which is provided to move the magnet armature relative to the yoke and to the guide. The bush does not touch the first mechanical stop in positions between the inoperative position and the central position. The bush touches the first mechanical stop in positions between the central position and the end position.

The central position is therefore defined as that position starting from which the bush touches the stop during closing. From the inoperative position to the central position, the first spring element substantially counteracts a closing force: if the magnet armature moves from its inoperative position to the central position, the first spring element is substantially compressed. In this case, a pretension which is greater than the tension on the first spring element in the central position can be applied to the second spring element. As a result, the second spring element is not compressed during the movement from the inoperative position to the central position.

If the bush strikes the mechanical stop, the tension on the first spring element cannot increase further since the force is emitted by means of the bush and the mechanical stop against the guide. Consequently, the further movement from the central position to the end position is made possible by compression of the second spring element.

It is possible that the contactor, in the yoke, comprises one or more coils which can generate a magnetic field and, together with the magnetizable material of the armature, form a solenoid.

The contactor can further comprise a hollow space in which the contact stamp on the magnet armature and two electrodes which are spaced from one another are arranged. The hollow space can be filled with a gas, for example a noble gas. The distance between the electrodes and the contact stamp is preferably smaller than the total stroke h of the magnet armature.

The magnet armature can additionally have a further spring element which can compensate for manufacturing tolerances in the distance between the electrodes and the contact stamp and generates the actual contact force. This is important particularly when the material of the electrodes or of the contact stamp is worn away by repeated switching operations at a high electrical power.

The solenoid of a contactor of this kind can be operated at an operating voltage of 12 V, 24 V, 48V or any other available voltage.

The contactor can have a hollow space, for example a hollow space which is filled with an inert gas, in which the contacts to be switched are located. A contactor with a gas-filled hollow space is usually called a GFC (Gas Filled Contactor). Since contactors of this kind are particularly suitable for switching up high voltages, they are also known as HVCs (HVC=High Voltage Contactor).

The service life, which is increased by the non-linear counterforce, can be further increased by the gas filling in the hollow space.

It is possible that the contactor has a guide with a third stop. The third stop can constitute a limit for the movement of the magnet armature. The magnet armature can, in its inoperative position, touch the third stop.

In this case, the third stop can absorb, in particular, the force of the first spring in the inoperative position. Therefore, the position of the third stop determines the position of the magnet armature relative to the guide in the inoperative position, a defined inoperative position.

In order to realize a defined value for h1 independently of the ratio of the spring rates, and in order to decouple the spring forces, the cylindrical section should have the fourth mechanical stop which, as described above, can be realized by two different diameters on the cylindrical section and the corresponding step. As a result, the second, for example stiffer, spring element can be dimensioned independently of the first, for example softer, spring element and installed by means of the bush and the fourth mechanical stop with a defined pretension.

The ratio of the spring rates is not limited. The numerical values (for example a spring hardness of 0.5 N/mm for the stiffer spring and 3 N/mm for the softer spring) depend, amongst other things, on the physical size and are provided to be understood only as examples.

Connection of the two spring elements in series is possible but not necessary. The mechanical stops, in particular the first and the fourth stop, can decouple the springs.

A method for switching an electromagnetic contactor which has a solenoid, a contact stamp and a first spring element comprises the steps of:

activating the solenoid in an inoperative position, accelerating the contact stamp against the restoring force of the first spring element up to a central position, moving the contact stamp against the restoring force of the second spring element up to an end position.

A method for switching an electromagnetic contactor which has an solenoid, a contact stamp a first spring element and a second spring element comprises the steps of:

activating the solenoid in an inoperative position, accelerating the contact stamp against the restoring force of the first spring element up to a central position, moving the contact stamp against the restoring force of the second spring element up to an end position.

The operating principle and exemplary embodiments are shown with reference to schematic figures and explained in greater detail below.

FIG. 1: shows a cross section through a simple embodiment of a magnet armature MA in its inoperative position, FIG. 2: shows a cross section through a simple embodiment in its central position, FIG. 3: shows a cross section through a simple embodiment of the contactor in its end position, FIG. 4: shows a cross section through an embodiment of a magnet armature with a spring element for tolerance compensation and with a contact stamp, FIG. 5: shows a cross section through a contactor with a magnet armature and with a contact stamp, a first electrode and a second electrode in a gas-filled hollow space, corresponding to the examples of FIGS. 5 and/or 6.

FIG. 6: shows a cross section through an embodiment of a magnet armature MA with a third A3 and a fourth stop A4, FIG. 7: shows a cross section through the embodiment of FIG. 6 in the central position, FIG. 8: shows a cross section through the embodiment of FIG. 6 in the end position, FIG. 1 shows the cross section through a simple embodiment of a magnet armature MA in its inoperative position RP. The magnet armature MA has a first spring element F1 and a second spring element F2. The two spring elements F1, F2 determine the restoring forces during the movement from its inoperative position to its end position. In particular, the first spring element F1 determines the restoring force during the movement from the inoperative position to the central position. The restoring force during the movement from the central position to the end position is determined by the spring stiffness of the second spring element F2. In this case, h1 is the length of the distance which is covered during the movement from the inoperative position to the central position. In this case, h=h1+h2 is the length of the distance which is covered during the movement from the inoperative position to the end position.

FIG. 1 shows, in addition to the magnet armature MA, a guide FÜ which limits the movement of the armature during the movement between the positions to a displacement along an axis. The guide FÜ can therefore constitute a guide rail with a first stop A1. A bush B is arranged between the first spring element F1 and the second spring element F2. The magnet armature MA has a cylindrical section ZA. The first spring element F1, the second spring element F2 and the bush B are arranged coaxially around the cylindrical section ZA.

The contact stamp KS is arranged at one end of the cylindrical section ZA. A magnetizable material M is arranged at the other end of the cylindrical section ZA. If the magnet armature MA, shown horizontally, moves to the left relative to the guide FÜ, the spring element with the lower spring stiffness, here the first spring element F1, is substantially compressed. If the second spring element F2 has a considerably higher spring stiffness or the second spring element F2 is under a pretension which is greater than the tension of the first spring element F1 in the central position, the second spring element F2 is not compressed or compressed only to an insignificant extent during the movement from the inoperative position RP to the central position MP. In this case, the bush B moves by the distance h1, until the bush B strikes the first stop A1, during the movement from the inoperative position RP to the central position MP. During this phase of the movement, the restoring force which acts on the magnet armature MA is provided substantially or exclusively by the spring stiffness of the first spring element F1.

FIG. 2 shows the magnet armature in its central position MP. In this case, the bush B touches the first stop A1. If the magnet armature is further moved to the left relative to the guide FÜ, the bush B is supported on the first stop A1, so that the first spring element F1 cannot be compressed further. The second spring element F2 is necessarily compressed during the further movement.

Accordingly, FIG. 3 shows the magnet armature in its end position EP. In this case, the second spring element F2 is compressed until the magnet armature reaches its end position which can be prespecified, for example, by a second mechanical stop A2.

The magnet armature is now located in a position in which an electrical switch which forms part of the magnet armature is closed by two electrodes touching the contact stamp.

A short closing time can be achieved during closing since the solenoid has to work only against the weak restoring force of the first spring element F1 and as a result can be rapidly accelerated, in particular in the critical initial phase. Rapid opening of the electrical switch is achieved by the second, stronger restoring force of the second spring element F2 immediately taking effect during deactivation of the solenoid.

Therefore, overall, a magnet armature is specified which allows both rapid closing and also rapid opening and which reduces, in particular, the burning time of an arising arc and the risk of the contacts sticking.

FIG. 4 shows an embodiment of the magnet armature MA in which a displaceable bush B is likewise arranged between a first spring element with a first spring stiffness k1 and a second spring element with a second spring stiffness k2. The rear end of the magnet armature MA has, in the direction of the contact stamp KS, a conical raised portion which is arranged coaxially around a cylindrical section of the contact stamp. The associated guide has a correspondingly shaped conical recess which faces the end of the armature. A self-centering guide is therefore obtained when the switch is closed. A further spring element FTA, which can compensate for vertical tolerances and generates the actual contact force, is arranged between the contact stamp KS and the remaining section of the armature MA. A section which is composed of an insulating material IM is arranged between the further spring element FTA and the remaining section of the armature in order to DC-isolate the electrical contacts, which are to be connected by means of the contact stamp KS, and the magnet armature.

FIG. 5 shows a cross section through a possible embodiment of a contactor SCH in its inoperative position RP. In addition to the magnet armature with its magnetizable material M, the contactor SCH has a yoke J in which electrical windings of a coil SP are arranged. FIG. 5 additionally shows a hollow space HR in which ends of a first electrode and of a second electrode are situated opposite the contact stamp KS. If the magnet armature is moved initially against the resistance force of the first spring element and subsequently against the stronger resistance force of the second spring element, the contact stamp KS is pushed against the ends of the two electrodes EL1, EL2, as a result of which the two electrodes EL1, EL2 are interconnected with one another. A gas, for example a noble gas, is contained in the hollow space HR in order to extinguish an arc as quickly as possible, in particular when the contact is opened, in order to protect the material of the electrodes and of the contact stamp KS.

Figure 1:
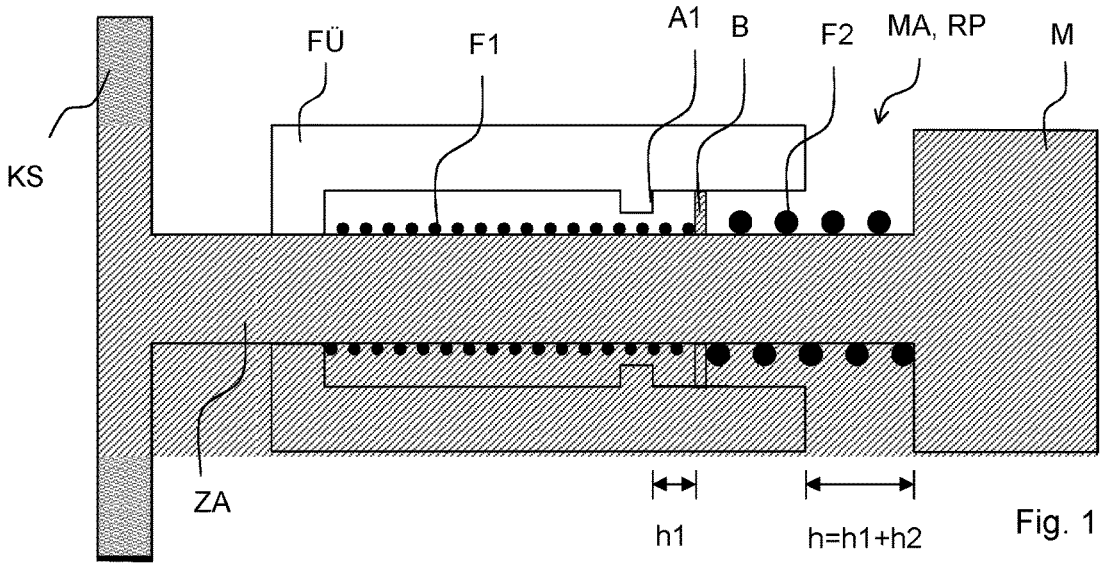
Figure 2:
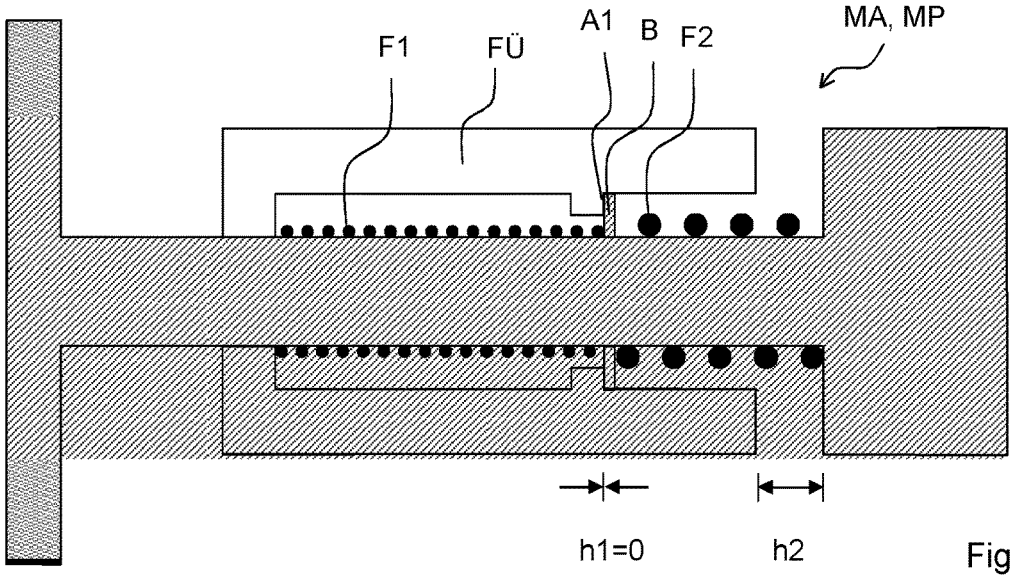
Figure 3:
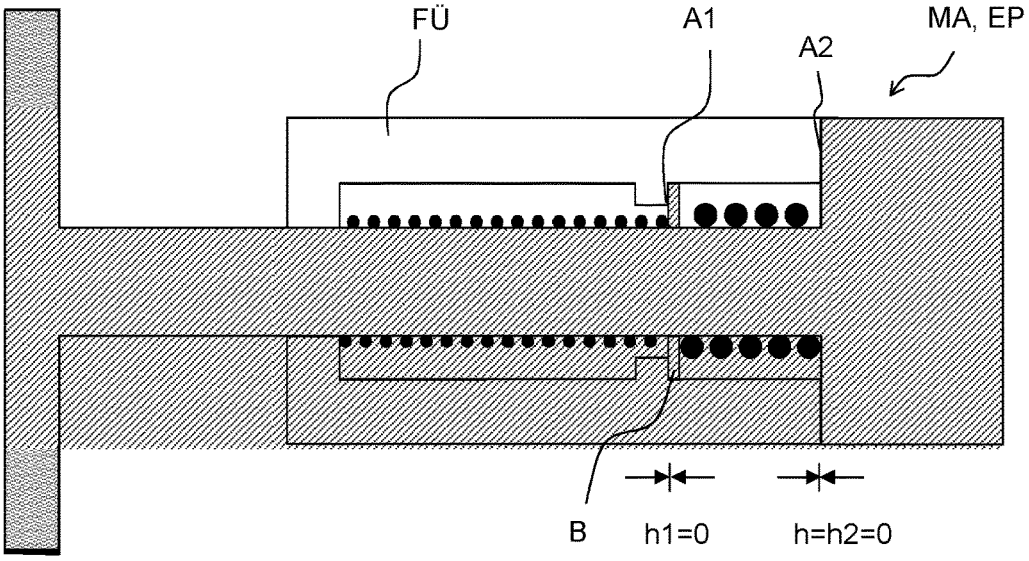
Figure 4:
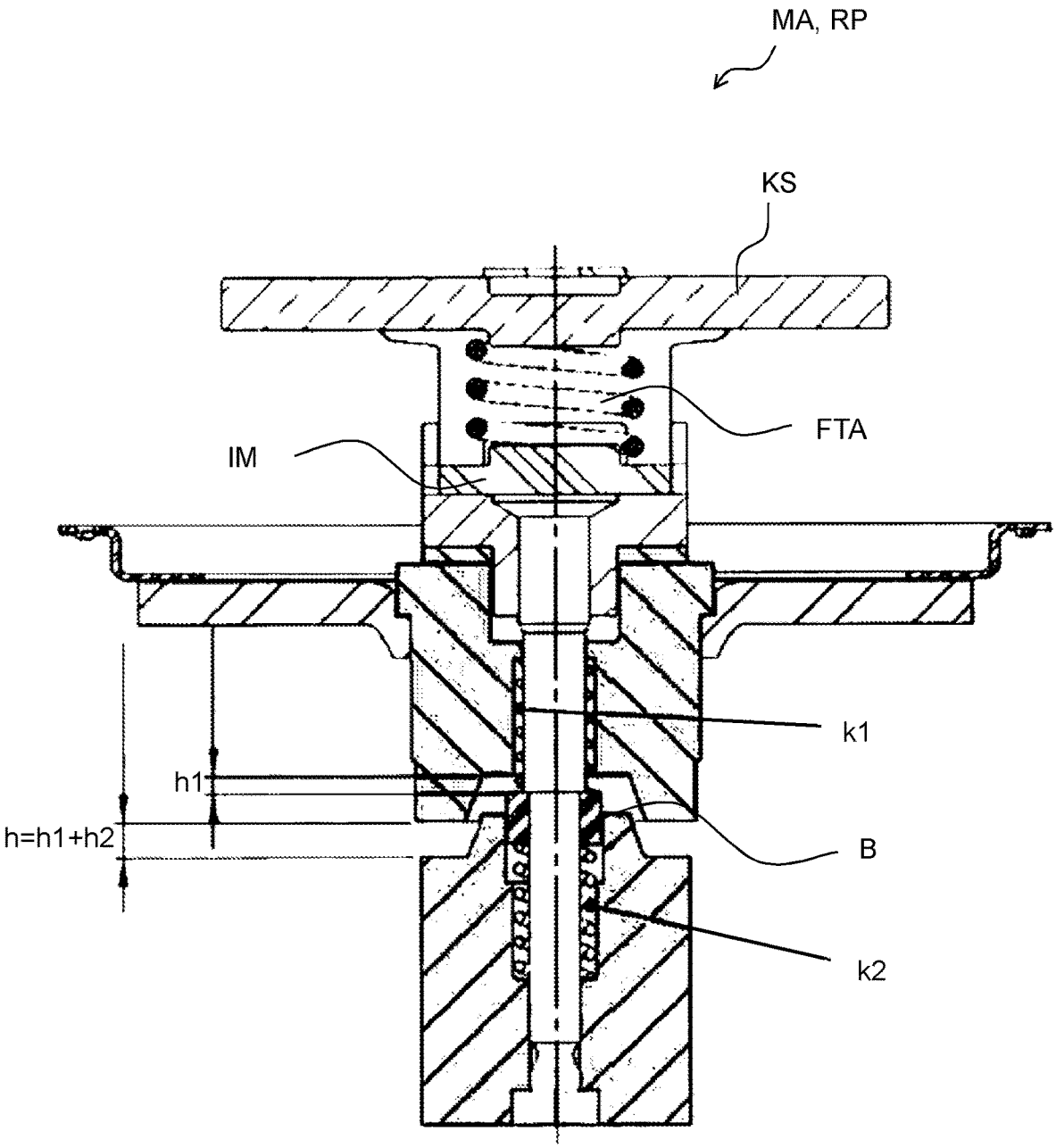
Figure 5:
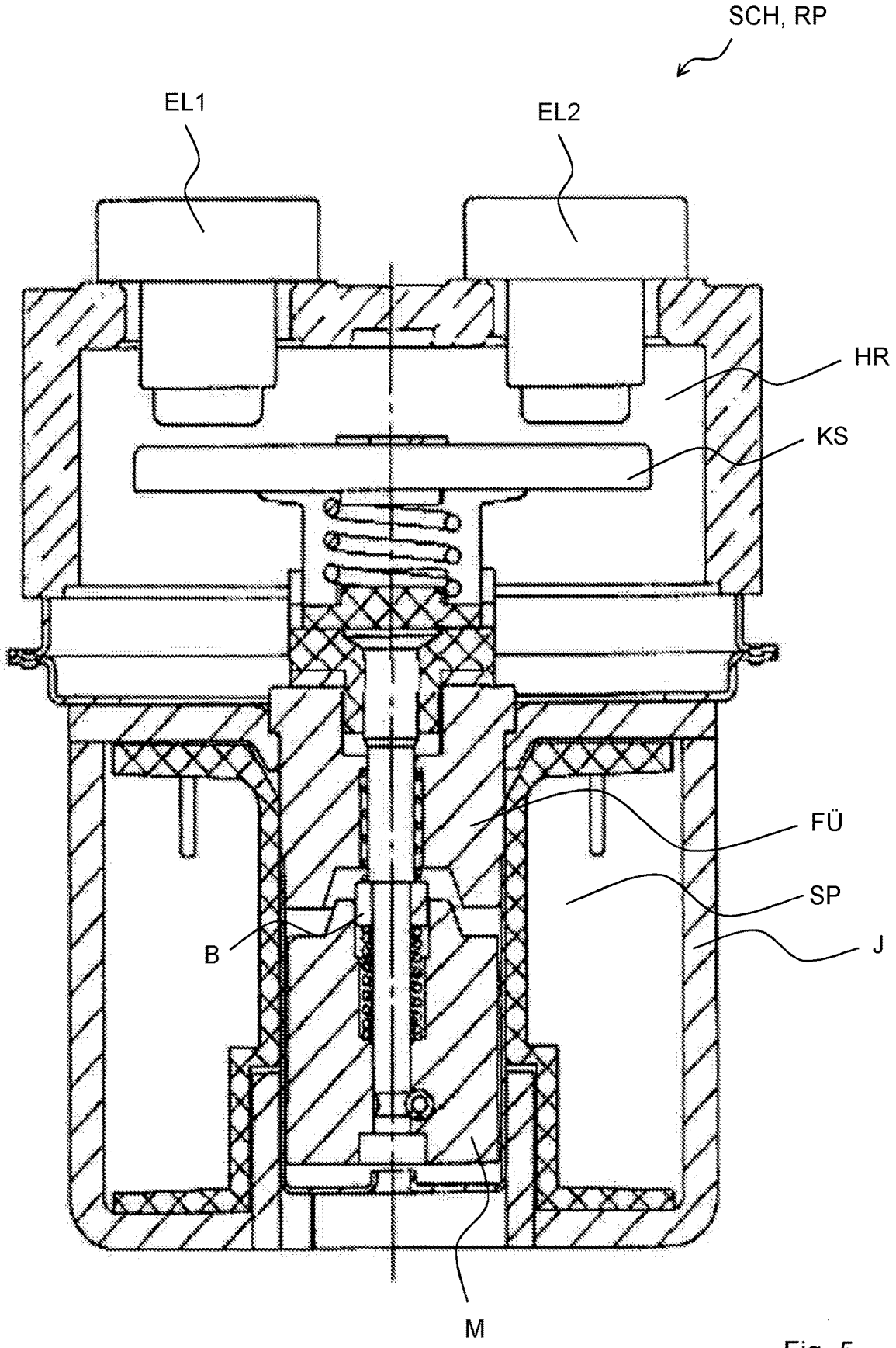
Figure 6:
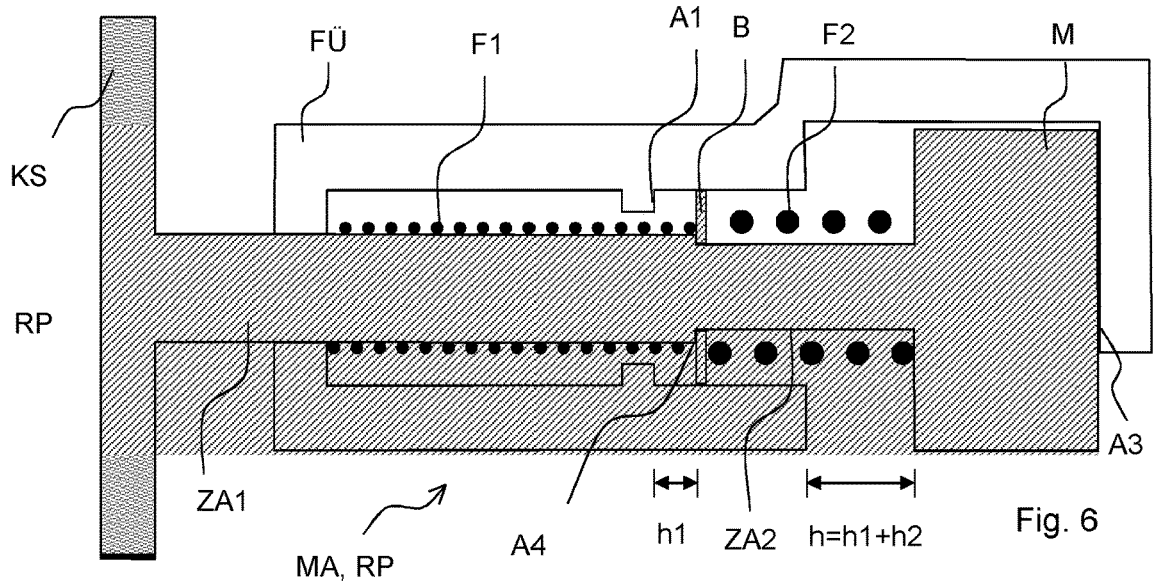
FIG. 6 shows an embodiment of the magnet armature MA with a fourth stop A4 and an embodiment of the contactor SCH with a third stop A3, in each case in the inoperative position RP. The position of the armature MA and the guide FÜ in the inoperative position RP is determined by the third stop A3.
Figure 7:
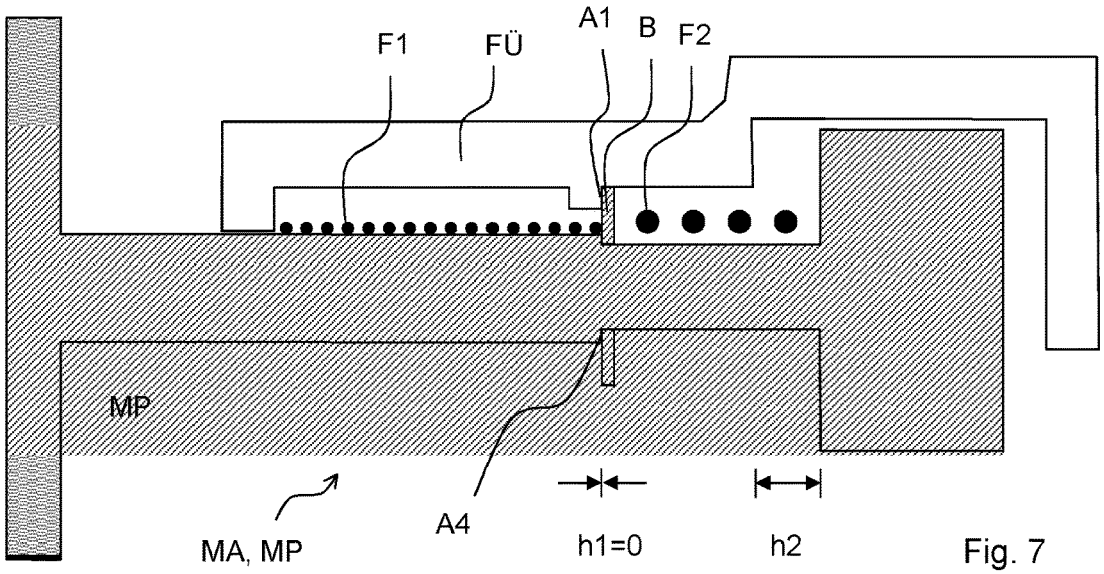
FIG. 7 shows an embodiment of the magnet armature MA with a fourth stop A4 and of the contactor SCH with a third stop A3 in the central position MP. This position constitutes a moment in the movement sequence in which the second spring element F2 is active.
Figure 8:
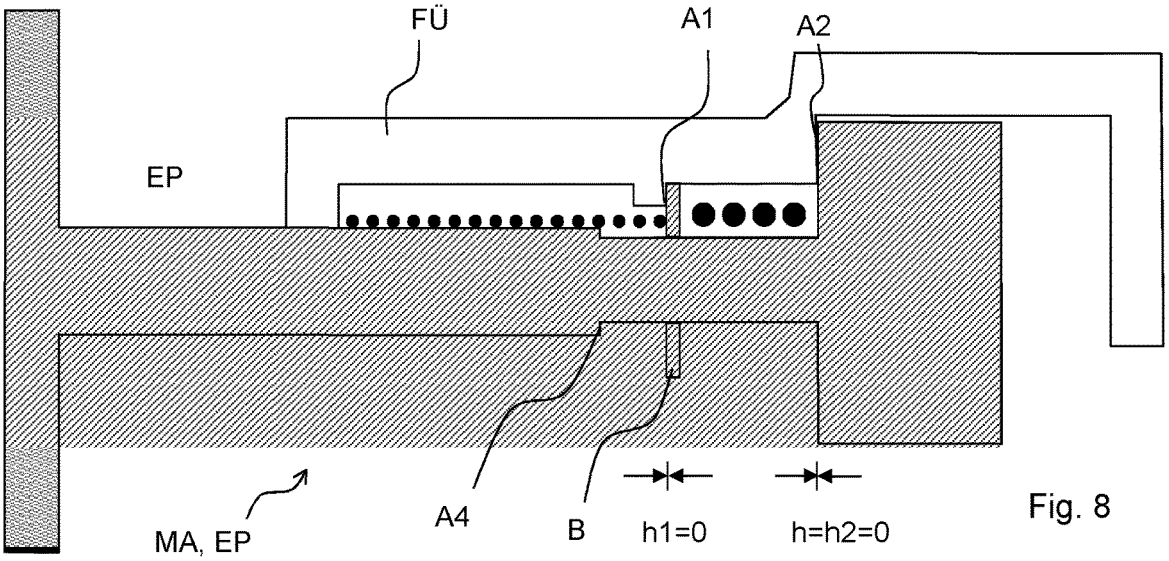
FIG. 8 shows an embodiment of the magnet armature MA with a fourth stop A4 and of the contactor SCH with a third stop A3 in the end position EP. The position of the armature MA and of the guide FÜ in the end position EP is determined by the second stop A2.

The following is clear from FIGS. 6, 7 and 8: in order to realize a defined value for h1 independently of the ratio of the spring rates and in order to decouple the spring forces, the cylindrical section ZA has the fourth mechanical stop A4 in the form of a step in the diameter. As a result, the second spring element F2 and the first spring element F1 are decoupled during a phase during activation until the central position of the contactor SCH is reached. In particular, the mechanical stops one, A1, and four, A4, decouple the springs F1, F2.

The invention specifies a contactor which, in spite of its magnet armature being of complex construction, has an improved electrical performance, can comply with customary geometric dimensions and therefore can be easily integrated into existing external circuit environments.

Neither the magnet armature nor the contactor nor the method for switching the contactor are limited to the exemplary embodiments shown. Magnet armatures with additional stops, apparatuses for pretensioning, in particular, the second spring element, and further measures for reducing the loading on the electrodes of a contactor constitute subjects according to the invention.

LIST OF REFERENCE SYMBOLS

A1: First mechanical stop
A2: Second mechanical stop
A3: Third mechanical stop
A4: Fourth mechanical stop
B: Bush
EL1: First electrode
EL2: Second electrode
EP: End position
F1: First spring element
F2: Second spring element
FTA: Spring element for tolerance compensation
FÜ: Guide
h: Distance of the length of the movement from the inoperative position to the end position
h1: Distance of the movement from the inoperative position to the central position
h2: Length of the distance of the movement from the central position to the end position
HR: Hollow space
IM: Insulating material
J: Yoke
KS: Contact stamp
M: Magnetizable material
MA: Magnet armature
MP: Central position
RP: Inoperative position
SCH: Contactor
ZA: Cylindrical section
ZA1: First subsection
ZA2: Second subsection

The invention claimed is:

1. A magnet armature, comprising
a first spring element with a first stiffness k1,
a second spring element with a second stiffness k2,
a bush between the first spring element and the second spring element,
a cylindrical section,
an inoperative position, an end position and a central position between the inoperative position and the end position,
wherein
the first spring element is provided to be elastically deformed during the movement from the inoperative position to the central position, but not during the movement from the central position to the end position,
the second spring element is provided to be elastically deformed during the movement from the central position to the end position, but not during the movement from the inoperative position to the central position,
the cylindrical section has a first subsection with a first diameter, a second subsection with a second diameter and a step between the two subsections,
the step between the two subsections constitutes a stop for the bush.

2. The magnet armature according to claim 1, wherein the first spring element and the second spring element are arranged in series.

3. The magnet armature according to claim 1,
further comprising a cylindrical section which the first spring element, the bush and the second spring element coaxially surround, wherein
the end of the first spring element which faces the bush is provided to move relative to the cylindrical section during the movement from the inoperative position to the central position, but not during the movement from the central position to the end position,
the bush and that end of the second spring element which faces the bush are provided to move relative to the cylindrical section during the movement from the central position to the end position, but not during the movement from the inoperative position to the central position.

4. The magnet armature according to claim 1, wherein a movement from the inoperative position to the end position corresponds to a displacement by a distance h=h1+h2 which is between 1.5 and 2.5 mm long, and the movement from the inoperative position to the central position constitutes a displacement by h1, and the movement from the central position to the end position constitutes a displacement by h2.

5. The magnet armature according to claim 1, wherein a movement from the inoperative position to the central position corresponds to a displacement by a distance h1 which lies in an interval of between 0.4 times and 0.6 times the distance h=h1+h2 of the displacement from the inoperative position to the end position, wherein the movement from the central position to the end position constitutes a displacement by h2.

6. The magnet armature according to claim 1, wherein $3.3 \leq k2/k1 \leq 3.6$.

7. The magnet armature according to claim 1, wherein 0.5 N/mm≤k1≤0.9 N/mm and 2.3 N/mm≤k2≤2.7 N/mm.

8. The magnet armature according to claim 1, further comprising a contact stamp and a magnetizable material, wherein the contact stamp comprises an electrically conductive material and, in its end position, is provided to interconnect two electrical contacts, and the magnetizable material comprises iron, cobalt or nickel.

9. The magnet armature according to claim 1, wherein the bush touches the stop during the movement from the inoperative position to the central position, and the bush does not touch the stop during the movement from the central position to the end position.

10. The magnet armature according to claim 9, wherein the bush decouples the two springs at least in one position.

11. A contactor (SCH), comprising a magnet armature according to claim 1 having, a yoke, a guide with a stop wherein the magnet armature and the yoke form an electromagnetic actuator which is provided to move the magnet armature relative to the yoke and to the guide, the bush does not touch the stop in positions between the inoperative position and the central position, the bush touches the stop in positions between the central position and the end position.

12. The contactor according to claim 11, wherein the guide has a second stop, the second stop constitutes a limit for the movement of the magnet armature, and the magnet armature, in its inoperative position, touches the second stop.

13. The magnet armature according to claim 2, wherein a movement from the inoperative position to the end position corresponds to a displacement by a distance h=h1+h2 which is between 1.5 and 2.5 mm long, and the movement from the inoperative position to the central position constitutes a displacement by h1, and the movement from the central position to the end position constitutes a displacement by h2.

14. The magnet armature according to claim 2, wherein a movement from the inoperative position to the central position corresponds to a displacement by a distance h1 which lies in an interval of between 0.4 times and 0.6 times the distance h=h1+h2 of the displacement from the inoperative position to the end position, wherein the movement from the central position to the end position constitutes a displacement by h2.

15. The magnet armature according to claim 2, further comprising a contact stamp and a magnetizable material, wherein the contact stamp comprises an electrically conductive material and, in its end position, is provided to interconnect two electrical contacts, and the magnetizable material comprises iron, cobalt or nickel.

16. A method for switching an electromagnetic contactor having a solenoid, a contact stamp, a first spring element and a second spring element, a bush between the first spring element and the second spring element, and a cylindrical section having a first subsection with a first diameter, a second subsection with a second diameter and a step between the two subsections constituting a stop for the bush, the method comprising the steps of:

activating the solenoid in an inoperative position, accelerating the contact stamp against the restoring force of the first spring element up to a central position, thereby elastically deforming the first spring element during the movement from the inoperative position to the central position, but not during the movement from the central position to the end position, moving the contact stamp against the restoring force of the second spring element up to an end position, thereby elastically deforming the second spring element during the movement from the central position to the end position, but not during the movement from the inoperative position to the central position, the central position being between the inoperative position and the end position.

* * * * *